US009867506B2

(12) United States Patent
Phillips

(10) Patent No.: US 9,867,506 B2
(45) Date of Patent: Jan. 16, 2018

(54) MODULAR SINK-SURROUNDING COUNTER TOP COVER

(71) Applicant: Geoff Phillips, San Diego, CA (US)

(72) Inventor: Geoff Phillips, San Diego, CA (US)

( * ) Notice: Subject to any disclaimer, the term of this patent is extended or adjusted under 35 U.S.C. 154(b) by 289 days.

(21) Appl. No.: 14/299,592

(22) Filed: Jun. 9, 2014

(65) Prior Publication Data

US 2015/0013062 A1 Jan. 15, 2015

Related U.S. Application Data

(60) Provisional application No. 61/844,319, filed on Jul. 9, 2013.

(51) Int. Cl.
*A47K 1/06* (2006.01)

(52) U.S. Cl.
CPC ..... *A47K 1/06* (2013.01)

(58) Field of Classification Search
CPC ..... A47K 1/06
USPC ..... 4/655, 658, DIG. 18
See application file for complete search history.

(56) References Cited

U.S. PATENT DOCUMENTS 5,248,536 A * 9/1993 Du Katz ..... G09F 1/10 40/594
5,815,856 A * 10/1998 Dore ..... A47K 1/06 4/654
6,223,362 B1 * 5/2001 Liang ..... A47K 1/06 4/245.4
6,338,171 B1 * 1/2002 Dandridge ..... A47J 47/20 4/657
8,088,468 B2 * 1/2012 Maggio ..... E03C 1/33 4/655
2007/0180610 A1 * 8/2007 Mohr ..... E03C 1/186 4/655
2013/0019397 A1 * 1/2013 May ..... A47J 47/20 4/658

* cited by examiner

*Primary Examiner* — Allana Lewin Bidder
*Assistant Examiner* — William R Klotz
(74) *Attorney, Agent, or Firm* — Donn K. Harms

(57) ABSTRACT

A cover for the surrounding surface adjacent a sink is provided having a body formed of flexible material. The body is configured with an aperture sized to surround the sink and shield a user from contact with the surrounding surface and the surrounding surface from a communication of liquid from use of the sink. The cover may be modular and formed of multiple components or may be configured of a sheet of material which has removable portions to allow customization for positioning to an as used position surrounding the sink.

6 Claims, 8 Drawing Sheets

MODULAR SINK-SURROUNDING COUNTER TOP COVER

This Application Claims Priority to U.S. Provisional Patent Application Ser. No. 61/844,319 filed on Jul. 9, 2013 and incorporated herein by this reference thereto in its entirety.

FIELD OF THE INVENTION

The device and method herein relate in general to a covering for the surfaces of sinks and surrounding areas. More particularly, the disclosed device relates to a modular cover configurable to surround sinks of differing configurations, and thereby provide a clean and dry textile or other planar surface for those surrounding areas. By forming the textile components to include an absorbent layer in combination with a liquid-impervious layer, the device aids in the prevention of the communication of infectious pathogens, to the user or their property and helps prevent liquids from landing on the areas surrounding a sink and damaging or causing a messy end result during use of the sink and counter area surrounding it by a user.

BACKGROUND OF THE INVENTION

Household and hotel bathrooms, hospital rooms and bathrooms, and commercial and public washrooms and restrooms conventionally provide recessed sinks formed into, or resting upon, a surrounding counter top. Both the sink and the surrounding counter top are employable by users for their personal hygienic needs. For example home, hotel, hospital, and other publicly-provided sinks are normally employed for hand and face washing, brushing one's teeth and in some cases, even laundering personal items like underwear and other clothing items.

Such sink and counter arrangements conventionally include sinks equipped with overhead faucets, which may be free-standing and built into the counter top as a unitary structure, or engaged with the sink itself which is supported by a surrounding counter top. Often splash guards are provided against the wall-supporting the counter to protect the wall surfaces from moisture.

Because of the general nature of use of sinks, and the free-flowing of water concurrently with the use of soap and other hygienic items, it is common to have the counter top splashed with liquid. Such may be water or mixtures of water and soap, or other chemicals such as hair coloring and the like. While porcelain or metallic sinks are not easily stained due to the nature of those materials, surrounding counters may be formed of plastic, stone, wood or mixtures of materials which are potentially easily discolored by splashed or otherwise projected water or liquids employed by the user for hygiene or other uses.

Be it a home sink, a hotel or hospital room sink, or a public-available sink, invariably over time and with enough users, the counter top surrounding the sink will become marked or stained by flying liquids and other materials. Frequently, such liquids may include for example, soap, hard water, nail polish, shampoo including water, body creams, toothpaste, gargle liquids, hair color, hygienic washes, and other liquids employed by users when positioned at a sink.

In the past, while a paper or cloth towel, when employed by a user concerned with overspray, may be partially beneficial in the wiping of splashed liquids from the open area surrounding the sink, the unprotected nature of the surfaces, and human nature, generally equate to many stains being imparted to surfaces surrounding the sink over time. Such staining may be exacerbated in publicly-used sinks, and while such staining may be somewhat lessened in a hotel or hospital room, such still occurs as a general rule. Further, while splashing occurs more frequently with younger users, the nature of the damage done by splashing increases with older sink users due to the nature of the liquids being used in proximity to the sink. Hair coloring, nail polish, and differing cosmetics can easily cause permanent staining in surfaces, especially expensive surfaces such as granite or marble.

An additional concern to subsequent users of hotel, hospital, and publicly-available sinks and countertops is that of the potential for encountering pathogens and contact with other undesirable materials and residue deposited by the use of the sink are by previous users. In hotels and in hospital, while housekeeping attempts to clean such surfaces, it is well known that disease causing pathogens, and other less than hygienic materials and fluid residues can remain. Contact with such can be unknowing by the subsequent user who lays their toothbrush on an infected countertop, or places their hand on the newly wet countertop surface and suffers a transfer of a pathogen or other unsanitary material.

However to date, prior art has not provided a solution to the problem of splashing and overspray by sink users and the damage thereby caused. Neither has a solution been provided for the hygienic dilemma of subsequent users of sinks and counters such as in hotels or in a hospitals. While the use of a conventional cloth towel is sometimes a partial solution for users, such towels do not fair well themselves from liquid staining on many occasions. Further, towels being rectangular do not easily cover the curved areas of sink-surrounding counters and splash guards and can leave the user exposed to whatever lurks on the countertop surface. Further most fabric materials tend to easily slide when placed on smooth surrounding areas and lack a liquid barrier and thus underlying pathogens or residue can communicate through the towel when it becomes wet. Paper towels have also been a common item for liquid splashing protection, however paper towels are also rectangular as well as being small in size, and thus do not provide good coverage.

As such there is an unmet need for a sink-surrounding protection device which will protect the surrounding surfaces from liquids being employed by a user, and will protect subsequent users of such sink surrounding areas from that which might be left from previous users thereon. Such a device should be modular in nature and easy to use and easily conform to the various shapes and curves and sizes of differing sink and counter configurations. Such a device should also be configured such that it stays in position once placed by the user. Still further, such a device should be configurable to be employed by users for wearing to protect users and their clothing during personal hygiene or stylist or cosmetic procedures.

As a notation those skilled in the art should appreciate that the conception, upon which this disclosure is based, may readily be utilized as a basis for designing of other sink surrounding liquid protection devices, methods and systems for carrying out the several purposes of the present disclosed device and method. It is important, therefore, that the suggested construction and operation and objects and claims of the sink surrounding apparatus and method herein be regarded as including such equivalent construction and methodology as would occur to those in the art, insofar as they do not depart from the spirit and scope of the present invention.

Further, the forgoing examples of background and state of the art and limitations related therewith, are intended to be illustrative of the known and general state of the art and not exclusive, and they should not be taken to imply any limitations on the invention described and claimed herein. Various limitations of the related art are well known, or will become apparent to those skilled in the art upon a reading and understanding of the specification below and the accompanying drawings.

SUMMARY OF THE PREFERRED EMBODIMENTS OF THE INVENTION

The device as described and disclosed herein provides a solution to the shortcomings of the prior art through the provision of a modular counter cover adapted for configuration to an as-used positioning, in a surrounding engagement with a sink and operative sealed engagement with the faucet thereof. The device, in an as-used position, may be user-configured to cover the countertop area surrounding a sink thereby provide a means for preventing contact of overspray and splashed and other misdirected liquids from contact with and/or staining of these sink-surrounding areas.

In a secondary but valuable mode of the device, it is also employable to second, or user-engaged as-used position wherein the head of the user will communicate through a formed aperture which also defines a sink opening. In either mode the device so position has a liquid barrier laminated or formed on one side surface of the device, thereby protecting the user when worn and the countertop when positioned thereon, from the communication of liquids and gels thereto.

In one preferred mode, the device is user-configurable to form a sink aperture in any rectangular, circular, oval or oblong shape, which will substantially mirror the shape of the perimeter of the underlying sink. The device is preferably provided with a plurality of modular components adapted for assembly to form differing sized or shaped sink apertures which match the dimensions of the user's sink.

The device may be formed of fabric such as terry cloth, fleece, chamois leather or similar soft-type cloth products, or may in some cases be formed as a light weight paper or plastic mat having a layered or a laminated structure of paper and a rear or underlying surface. The underlying surface is preferably formed of a non slip and/or liquid impervious layer of plastic, polymeric, or other material adapted to prevent communication of liquid therethrough.

The device may be provided in components forming plain configurations or with components capable of forming decorative configurations with multiple or solid colors including a variety of color printed, embossed or woven type designs for a licensed, promotional or visual aesthetic effect. In one preferred mode of the device it can be provided with components bearing indicia thereon, as a means for advertisement with the placement of such promotional indicia thereon on an upper or user-viewed surface when the device is in the as-used position. Such advertising or indicia would encourage the free distribution of the device to users through the sale of advertising, or the purchase of the device by users as a souvenir for instance of the hotel or city they are visiting.

In favored configurations, the body of the device includes two elongated openings running substantially parallel to each other on opposing side components defining the sink aperture. Each of the openings may have differing spacing from the body exterior edge and perimeter of the sink opening or aperture, which when reversed in positioning, allows the device to accommodate a communication therethrough of differing faucet and spout and sink configurations. These apertures may include a neoprene or other elastic material adapted to compressibly engage around the faucet or spigot.

The device may be one use and disposable when formed of paper like material, or it may be formed from material other than paper, such as textile or woven materials, or other materials adapted for reuse. If formed of modular components, the device may be formed of paper or disposable components to render it modular and configurable to the sink at hand by using adhesive engagement points. If formed of textile or other reusable material which is washable or dry-cleanable in conventional household, commercial or industrial washing machines to allow such reuse, the modular component may be engaged using hook and loop fabric or similar removably engageable material. The circumference of the modular components forming the openings and sink apertures of the device, may be alternatively reinforced to render them more sturdy. Further, pockets may be formed into the components for storage of travel articles or jewelry and the like.

Still further, women and men users may employ the device engaged around their necks, and positioned in either direction and on either side of their respective torso as a means for avoiding the inherent problems related to liquid splashing their clothes during the hair-washing and hair-styling process. By wearing the device herein, with their head and neck communicating therethrough, the device may be positioned configurations in which the longer side is positioned on opposing front and rear surfaces of their body and provide protection against contact of liquids and powders and the like from contact with their clothing such as their blouses, shirts, or suit, and/or their sleeve area depending on the positioning of the device relative to their body. The device may be provided in a plurality of sizes to accommodate a plurality of people sizes and potential encounters with liquid or powders and the like.

In the mode of the device used for user liquid or powder or other contact protection, the liquid blocking layer or surface may also be formed to communicate across the sink opening. In such a configuration it may be provided with an openable slit or slot for communication of the user's head therethrough. This configuration in an as-used position on a user, positions the liquid barrier layer, also employable for traction of the device on a counter or sink, as an impervious or non-penetrable barrier.

In this mode, the device may be reversed for wearing purposes thereby positioning the softer terry cloth, or textile, or paper material, in contact with the body of the user. Because the body or lighter clothing as worn by men or women while employing the device as a liquid shield will allow a "fall-off" effect of cut hair, shampoos, water and lotions and the like, the device may be usable multiple times for each client and customer without contamination transfer occurring between each additional customer.

It is an object of this invention to provide a modular sink surrounding apparatus, which being formed of user-engageable components, is user-configurable to form a cover adapted to fit a countertop surrounding a sink.

It is a further object of the invention to provide such a countertop cover with a layer of fluid resistant material.

Yet another object of the invention is to provide such a countertop cover for the surrounding of a sink, which provides the user cover to prevent communication of prior deposited residues or pathogens on the countertop, to the user or their possessions.

Further objects of the modular sink surrounding invention will be brought out in the following part of the specification, wherein detailed description is for the purpose of fully disclosing the invention without placing limitations thereon.

BRIEF DESCRIPTION OF THE DRAWING FIGURES

In the drawing figures, which are not to scale and which are merely illustrative and wherein like reference characters denote similar elements throughout the several views.

Figure 10:
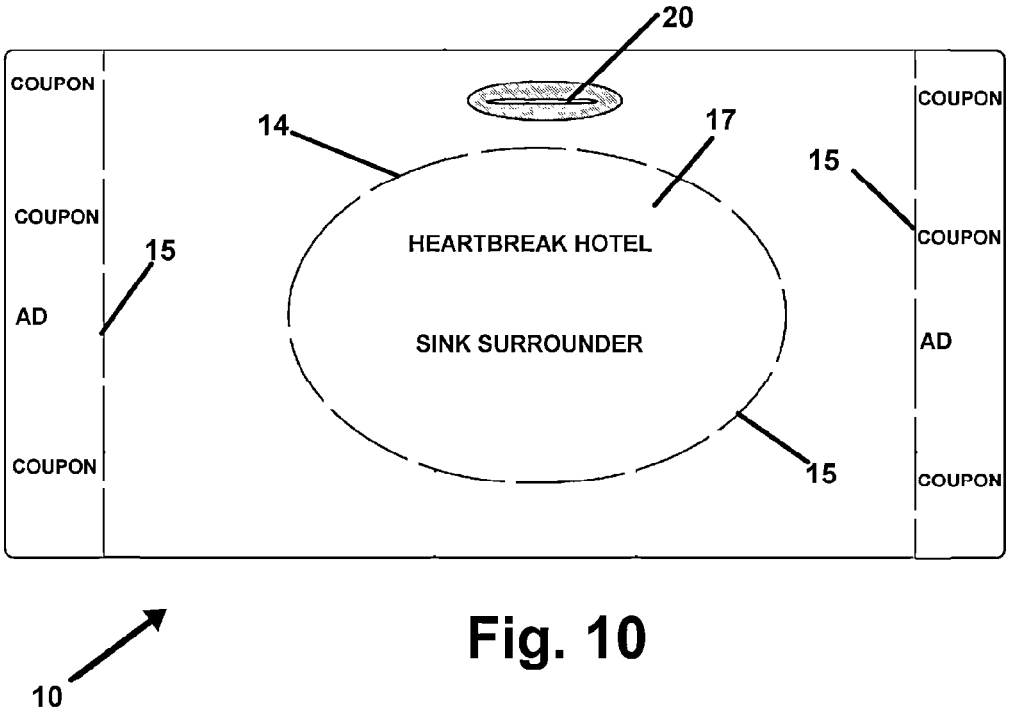
FIG. 10 depicts an additional favored mode of the device herein as would be employed in a large hotel with known sink and counter dimensions and formed of paper or other recyclable material.
Figure 10A:
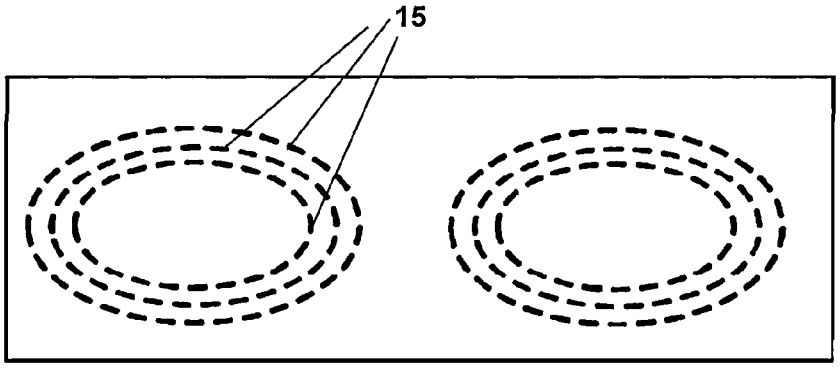

FIG. 10*a* shows a plurality of frangible sections which may be provided to allow user choice of a size of the sink aperture to employ by removing the portion surrounded by the frangible line sized to match the sink of choice.

Figure 3:
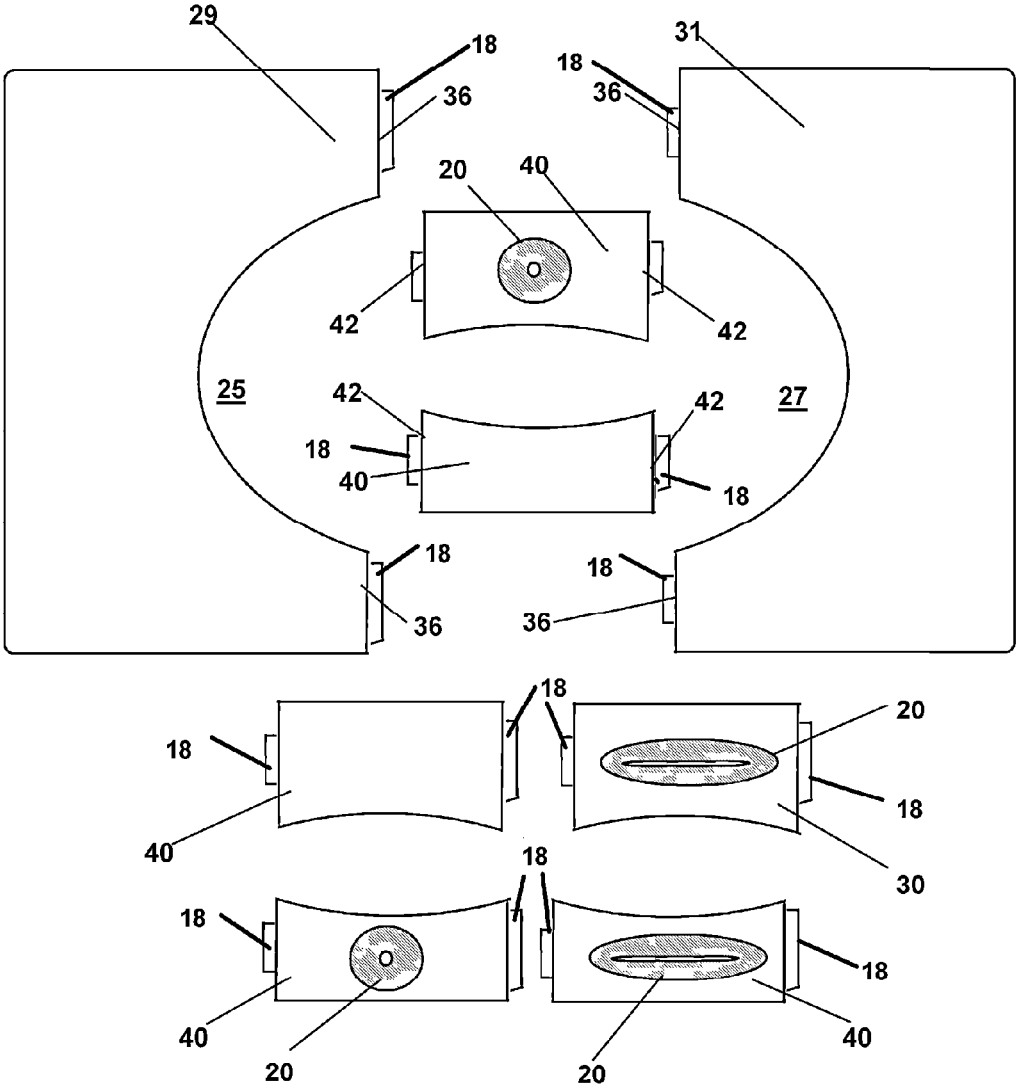
FIG. 3 depicts a plurality of differently configured center components provided to form the device such as shown in FIG. 1 or FIG. 2.
Figure 11:
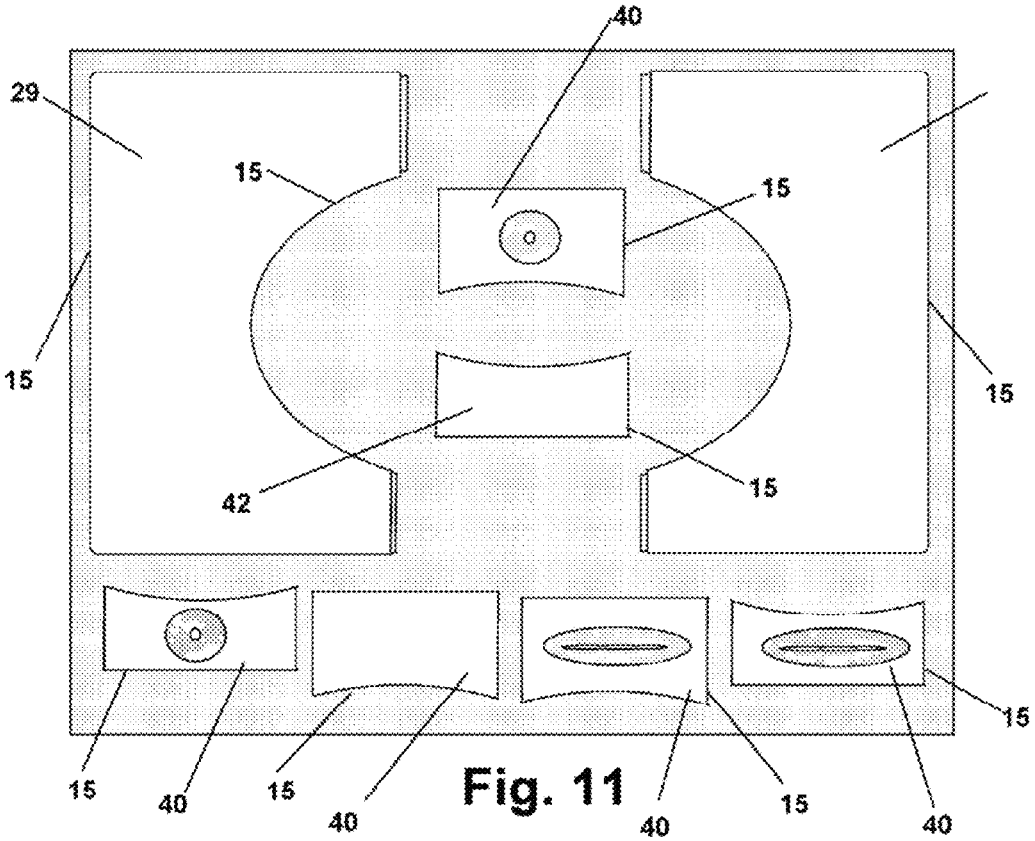

FIG. 11 depicts a mode of the device such as in FIG. 3, wherein the provided plurality of engageable components to form the device are defined by frangible lines cut into the material rendering the components separable from the sheet containing them.

Figure 12:
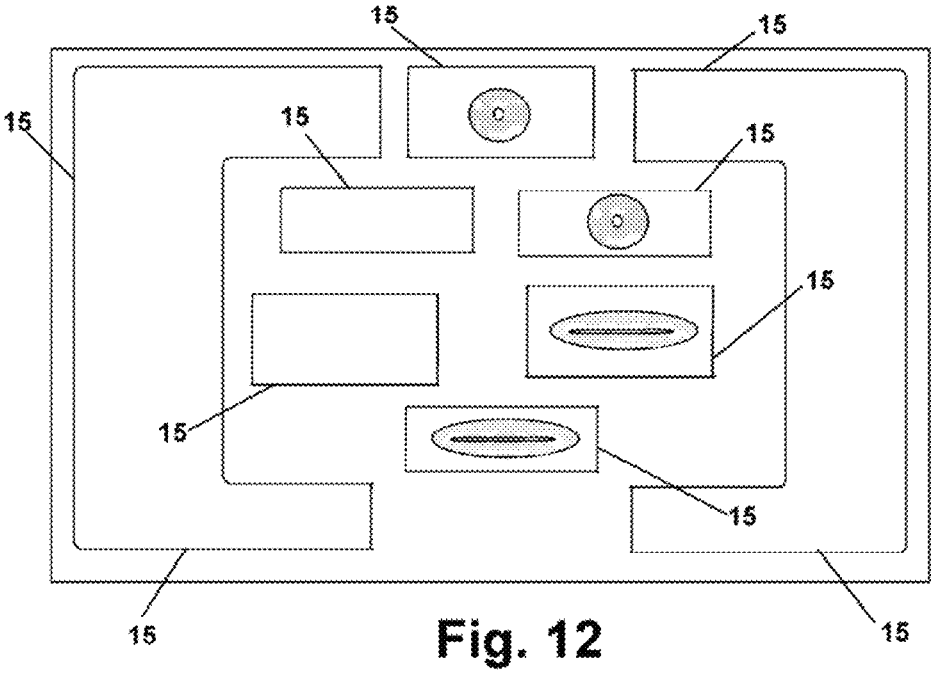

FIG. 12 depicts another mode of the device herein similar to that of FIG. 11 wherein the components to modularly form the device may be separated from the sheet of material along frangible lines defining their shape.

DETAILED DESCRIPTION OF PREFERRED EMBODIMENTS OF THE DEVICE

Figure 1:
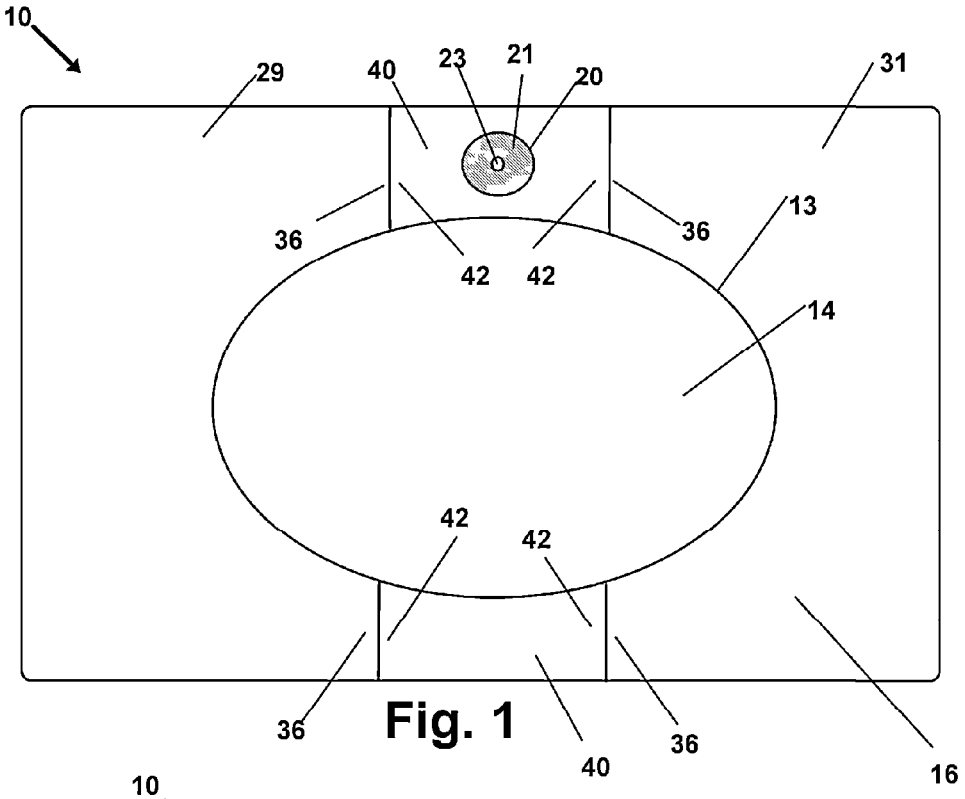
FIG. 1 depicts a top plan view of the device shown configured with modular components to fit an oval sink aperture having a single spigot on one side.

Now referring to drawings in FIGS. 1-10, wherein similar components are identified by like reference numerals, there is seen in FIG. 1, the device 10 herein described and disclosed assembled from modular components to form countertop cover supported by the countertop surrounding an oval shaped sink with a single spigot adjacent thereto.

Figure 6:
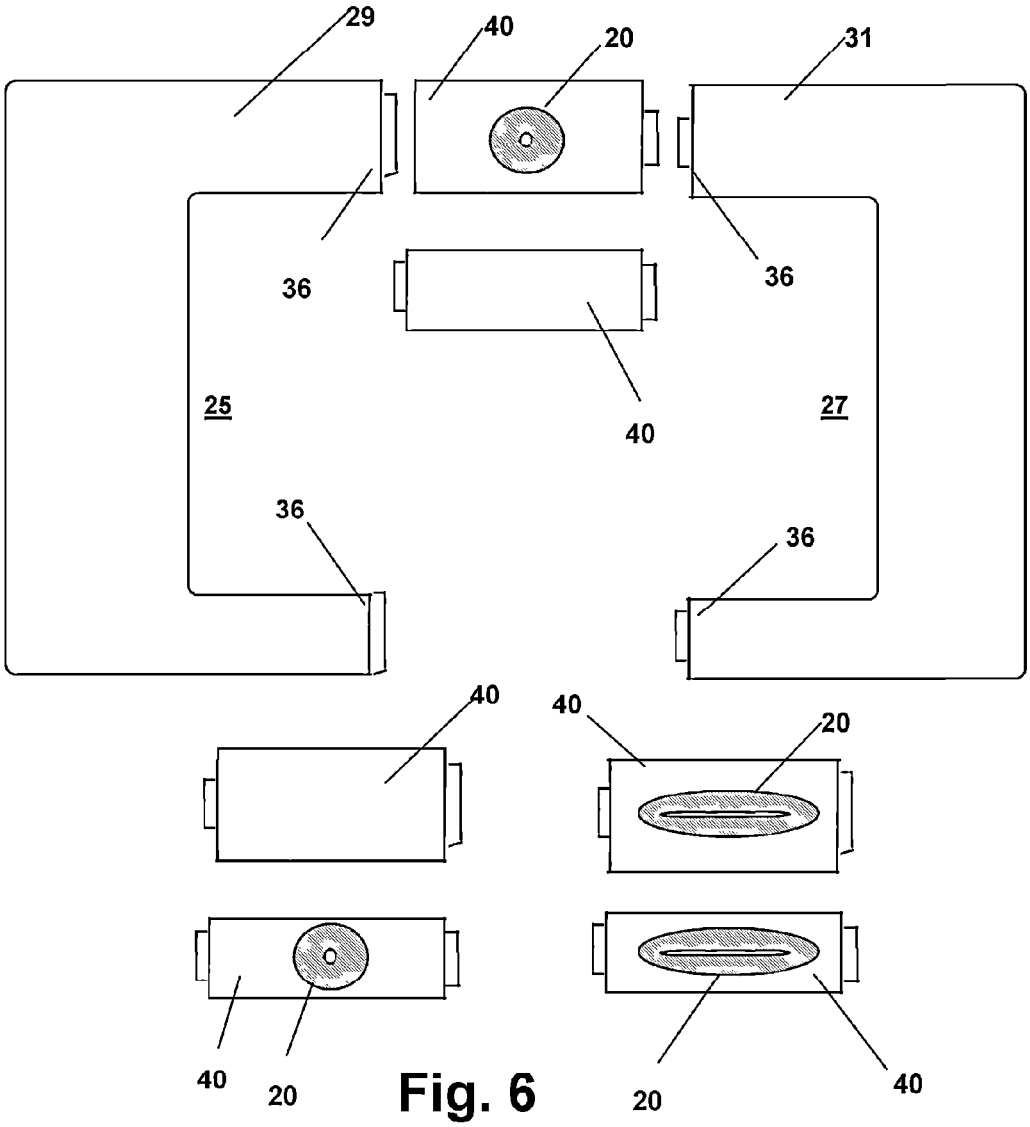
FIG. 6 is an overhead plan view of the components of the device herein which are removably engageable to form the device of FIG. 4 or 5.

The device 10 when assembled from the modular components as for example in FIGS. 3 and 6, and deployed in an as-used position, to cover the area surrounding a sink, provides a means for preventing contact of overspray and splashed and other misdirected liquids from contact with and/or staining of the surrounding areas as well as a means to prevent communication of liquids or residues or other materials or pathogens on the surrounding area, to the user or their possessions.

In a preferred mode of the device 10 part or all of a rear surface 12 may be covered or laminated with a protective polymer, plastic, neoprene or similar fluid barrier material which is either inherently non-slip, or configured with a surfacing adapted for gripping, and which forms a liquid-impervious layer or surface 12. If only some of the rear or contacting surface 12 has this laminated or substantially liquid impervious surface 12, it will provide enhanced traction for preventing slippage as well as means for preventing communication of previously deposited liquid or residue to their person or possessions. If the entire rear contact surface is covered, the device 10 will be provided with a liquid blocking and traction increasing surface 12 throughout its entire area.

In the alternative, a means to prevent slippage may be provided by an elastic perimeter of the edge 13 forming the sink aperture 14 which may cause a slight bunching thereof and recessing along the underlying sink edge. Still further, the material forming the top surface 16 as well as the material forming the surrounding area contacting surface 12 may be impregnated or otherwise imparted with a bacterial or anti-pathogenic material such as silver ions or some other material which may mix with the polymeric or plastic surface 12 material and form a solid solution of liquid impervious material which also has bacteria and pathogen eliminating ability.

Figure 2:
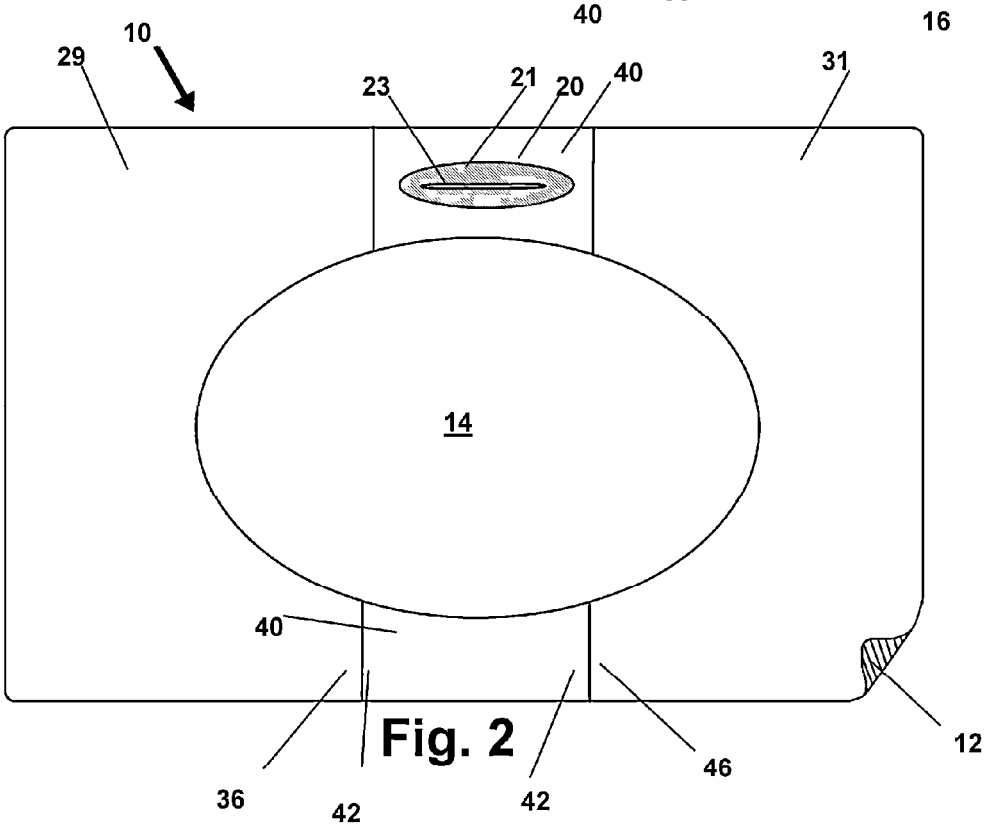
FIG. 2 shows a second view of the device similar to FIG. 1, depicting a component engaged with an elongated faucet opening.
Figure 4:
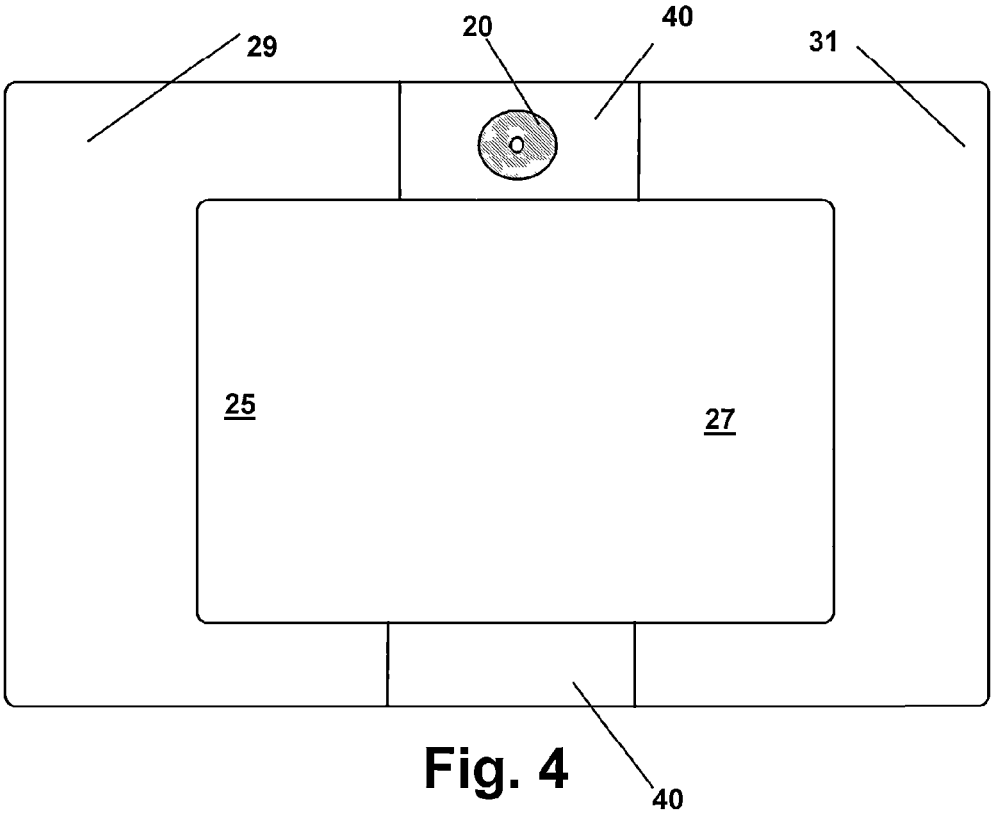
FIG. 4 is an overhead plan view of the components of the device herein formed to surround a rectangular sink with a single spigot.
Figure 5:
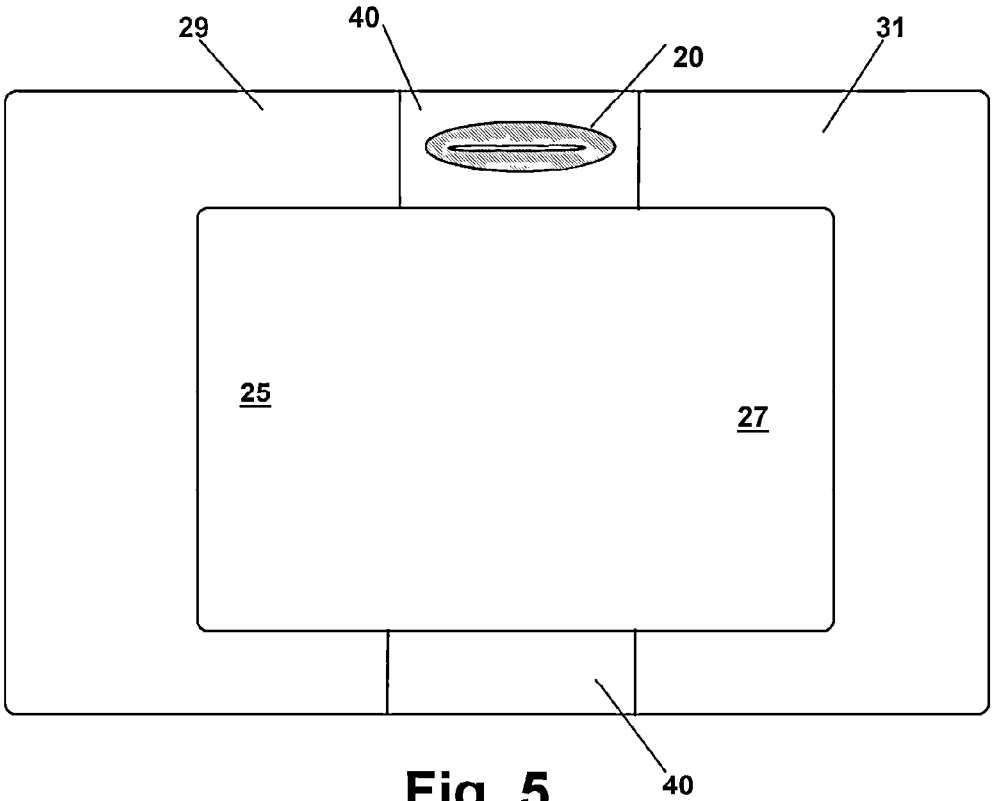
FIG. 5 is an overhead plan view of the components of the device herein similar to that of FIG. 1, formed to surround a rectangular sink with an elongated faucet body.

The sink aperture 14 is shown in FIG. 1-2 as oval-shaped and in FIG. 4-5 as rectangular in shape, depicts the fact that the modular components such as in FIGS. 3 and 6 configured to form the device 10, may be configured to form any shaped aperture 14 in the device 10 herein. It is this modular component configuration which gives the device 10 the ability to be configured for use with any shaped sink, and with multiple faucet configurations. In operation, the modular components are engaged together using connective sections 18 (FIG. 3) which are complimentary to each other on engaging edges, such a hook and loop fabric or adhesive, to form the device 10 with the sink aperture 14 of proper shape. So formed, the device 10 is supported by the countertop surrounding a sink, from the perimeter thereof outward.

The device 10 body 11 may be formed of one or a combination of materials from a group including textile fabric, planar polymeric material, terry cloth, fleece, chamois leather, or paper, or similar soft-type cloth products when combined with a layer of the underlying surface 12 material, is formed of a layered or laminated structure. Thus, the top surface facing the user when the device is in the as-used position, may be woven or knitted or other textile material, or paper, or other material fit for the purpose, and may bear indicia 30 (FIGS. 7 and 8) for advertising or as a geographic designator of the source, to encourage purchase and widespread use.

So provided, the device 10 may have liquid-absorbing and drying soaked areas, provide a handy device 10 for employment to offset soapy or soapy-free water and other type liquids such as shaving cream, gel or the like, perfume liquids, toothpaste other liquids used in bathrooms, kitchens, garages, and the like, which are likely to be splashed on the immediate area surrounding the underlying sink, surrounded by the perimeter of the sink aperture 14.

The device 10 is especially well suited for provision to guests in a hotel or hospital, who may wish to separate themselves and their toiletries from contact with the sink and/or surrounding surfaces, which has been used by a substantial number of preceding room occupants, and which have been known to be less than sanitary, due to the high turnover of hotel and motel rooms and in modern hospital with minimal stays, and very quick housekeeping service in between guests.

The device 10 may be provided in plain or solid colors, or it may be provided for repackaging with designs stamped, embedded or sublimated into the materials forming the body 11 including a variety of color printed, embossed or woven type designs for licensed, promotional or visual aesthetic effect.

Figure 7:
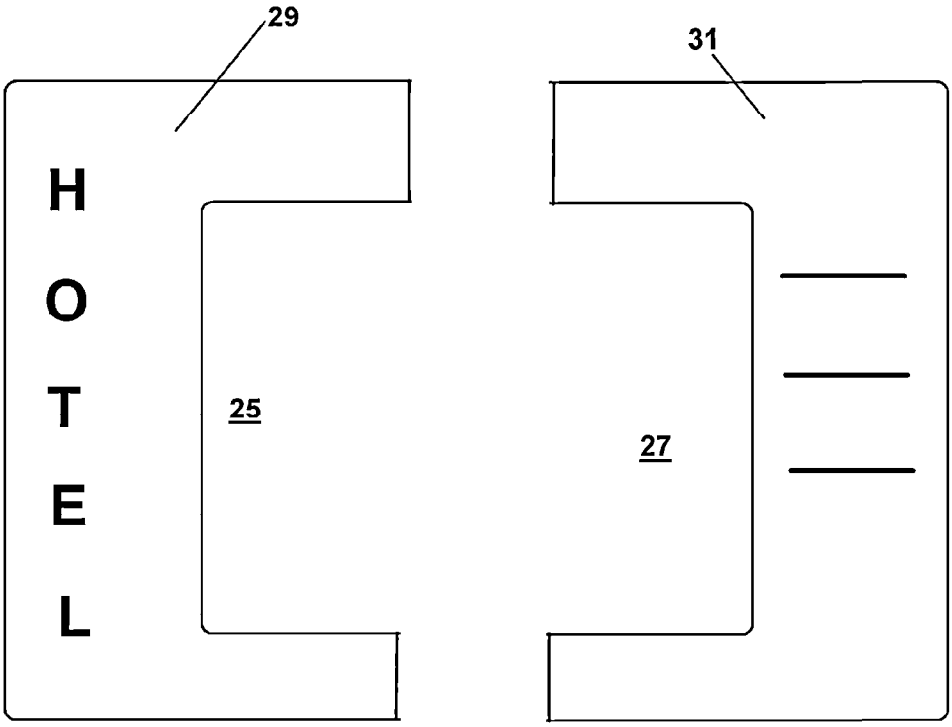
FIG. 7 depicts components for the modular kit which can be included with indicia thereon for advertising and optional pockets.
Figure 8:
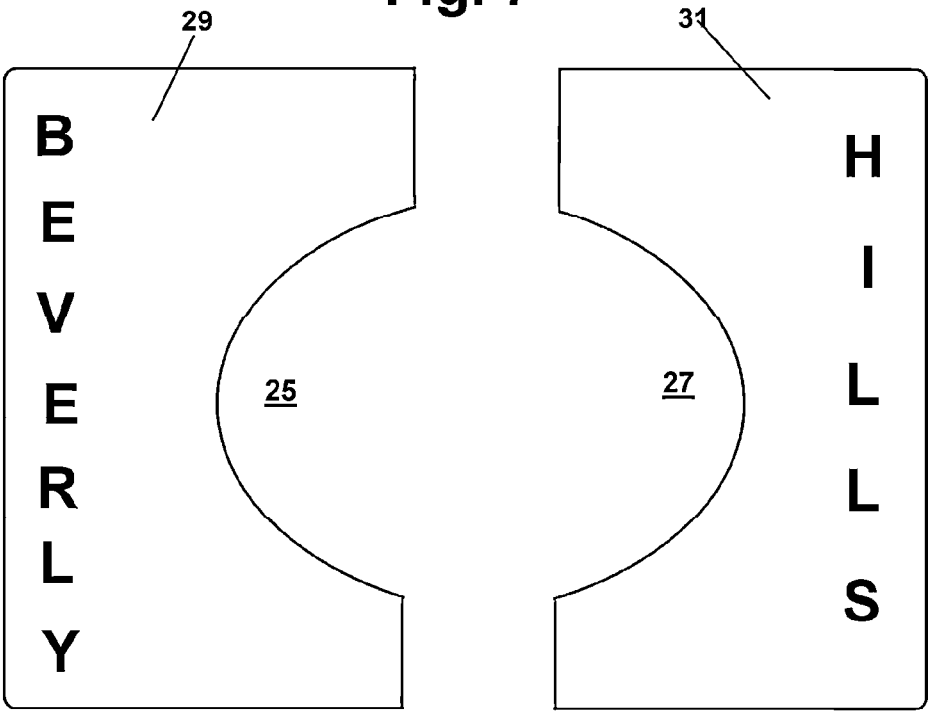
FIG. 8 depicts components for the modular kit of the device bearing geographic-related indicia which is employable for sale of the devices as souvenirs.

In a particularly preferred mode of the device 10 as shown in FIGS. 7 and 8 and 10, it would be provided as a means for advertisement and placement of promotional or other indicia 30 thereon. Such would encourage the free provision of the device 10 to users in public places where sanitary conditions of areas surrounding a sink might be suspect due to the high volume of people using such public sinks.

The device 10 body 11, formed of an assembly of a plurality of body components such as in FIGS. 3 and 6, will include die-cut areas forming openings or apertures such as the sink aperture 14, which as noted will be configured to match various size sinks, or in the case of wearing the device 10 user necks or heads. The components are rendered removably engageable by the provision of cooperating fastener sections 18 which the body components each have on opposing edges to allow for a removable engagement to the as-used configuration. Such may be hook and loop fabric, reusable adhesive, or other means for removable engagement of component edges to adjoining component engages to form the device 10 from the modular components.

Additionally, as noted previously, faucet openings 20 may be provided in a fashion which is adapted for slip-over engagement of faucets in addition to the cut outs on the assembled components to form the sink aperture 14 in any sink shape such as rectangular or square as in FIGS. 4-6 or for instance, or in oblong, or round, or oval shapes. Of course, where the device 10 is provided for a known shape sink, such as in a hotel, the additional components shown in FIG. 3 would not be necessary since the known configuration would allow provision four pieces to form the device 10. The formed aperture for the sink perimeter may be in any shape and size in an infinitely variable fashion, depending on the eventual use. For example, in a hotel or hospital setting having hundreds of rooms all with the same sink and counter, the components forming the device 10 may be provided to fit the sinks in the hotel or hospital, and the device 10 may be customized with indica 30 which may bear the hotel name, a hospital name, or other local advertising, to encourage use and to provide the device 10 as a souvenir of the guest's stay, which will continue to advertise the hotel, or a hospital in subsequent uses.

In a favored mode of the device 10 the body 11 includes two elongated openings 25 and 27, running substantially parallel to each other on each of two side components 29 and 31 which occupy positions on opposing sides of the sink aperture 14 when the device is engaged in the as-used position. Each of the side components 29 and 31, have mating edges 36 running traverse to the edge of the aperture formed by the openings 25 and 27.

Between the mating edges 36 of each of the two opposing side components 29 and 31, can be engaged central sections 40 which have a width substantially equal to the length of the mating edges 36 and have opposing side edges 42 having a mating fastener to that positioned on the mating edges 36 which in FIGS. 3 and 6 is shown as hook and loop fabric one half of which is positioned on the mating edges 36 and the other half of which is positioned on the side edges 42.

The central sections 40 may include a faucet opening 20 to accommodate communication therethrough of faucets and spouts with a cooperative shape to that of the faucet opening 20. The opening 20 provides a passage for the faucet thereby allowing the formed body 11 of the device 10 to be manipulated over the faucets and spouts and thereafter lay upon the sink or counter areas adjacent the faucet and sink, when in the as-used position and covering the areas surrounding the sink.

Particularly preferred in the faucet openings 20 is an elastic sleeve 21 having an aperture 23 formed therein which is equal to or smaller than the diameter of the faucet at its communication point through the opening 20. This elastic sleeve 21 and aperture 23 thus engage over the circumference of the faucet in an elastically compressive engagement, thus placing a liquid seal between the faucet and the underlying sink or counter.

Because faucets and spouts have varying spacing relative to the sink they serve, the central sections 40 may be provided in the modular kit in a plurality, where different sized faucet openings 20 are included with an elastic sleeve 21 and aperture 23 configured to slide upon and engage a circumference area of the faucet when the device 10 is laying upon the counter surrounding a sink. The spacing of the openings 20 from the sink aperture edge and the exterior edge of the component-formed body 11 of the device 10 can vary to accommodate differing manufacturers and configurations.

If formed of material other than paper, such as textile or woven materials, or other materials adapted for reuse, the device 10 will be washable or dry-cleanable in conventional household, commercial or industrial washing machines to allow such reuse. The circumferential edge 12 of the aperture defining the sink aperture 14 or the openings 21, may be alternatively reinforced by gluing or stitching or other means for reinforcement, and/or the body 11 itself may be reinforced around the edge 13 forming the sink aperture 14 and/or openings 20 with stitching, applique, gluing, sewn tape, or additional laminated adhered material layers, to reinforce the body 11 and the perimeter of the sink aperture 14 and/or the openings 20.

In some cases as noted, the edge on either the faucet side, or the opposite side of the formed sink aperture 12 may be wider or narrower. The modular components shown unassembled in FIGS. 3 and 6, provide the assembleable components in a kit with a plurality of the central components 40 with each having a differing wider or narrower width between their respective side edges 42 sized to mate with the width of the mating edges 36. As shown, the width of the central components 40 can be narrower or wider and, can include a faucet opening 20 of one of a plurality of dimensions, or can be without such an opening 20. This provision of central components 40 of multiple widths, and with differing dimensioned openings 20, allow the user to assemble the body 11 of the device 10, to fit the type of faucet shape in the installation of the device to the as-used position, and to accommodate narrower and wider areas of the surrounding surface of the sink, since such sinks can be positioned closer to and further from the edge closest to the user.

Thus, during assembly of the modular components forming a body 11 of the device 10 the user would access the width of the countertop area between the edge of the countertop closest to their body, and the edge of the sink opening required, and the shape of the faucet at or near its intersection with the sink or countertop. The user would then choose the two central portions 40 having a respective width to match the mating edges 36 of the two opposing side components 29 and 31, one of which would also be chosen as having the appropriate dimension for the faucet opening 20 to accommodate the faucet intended. The four components would then be engaged using the fastener sections 18 such as hook fabric on the mating edges 36 with loop fabric on the side edges 42.

Once assembled, the body 11 of the device 10 would be positioned on the countertop, to place the cicumfrential edge 13 of the sink aperture 14, adjacent to or in contact with the circumference of the sink, and concurrently engage the faucet opening 20 around the faucet, and thereby place the assembled device 10 to the as-used position.

Figure 9:
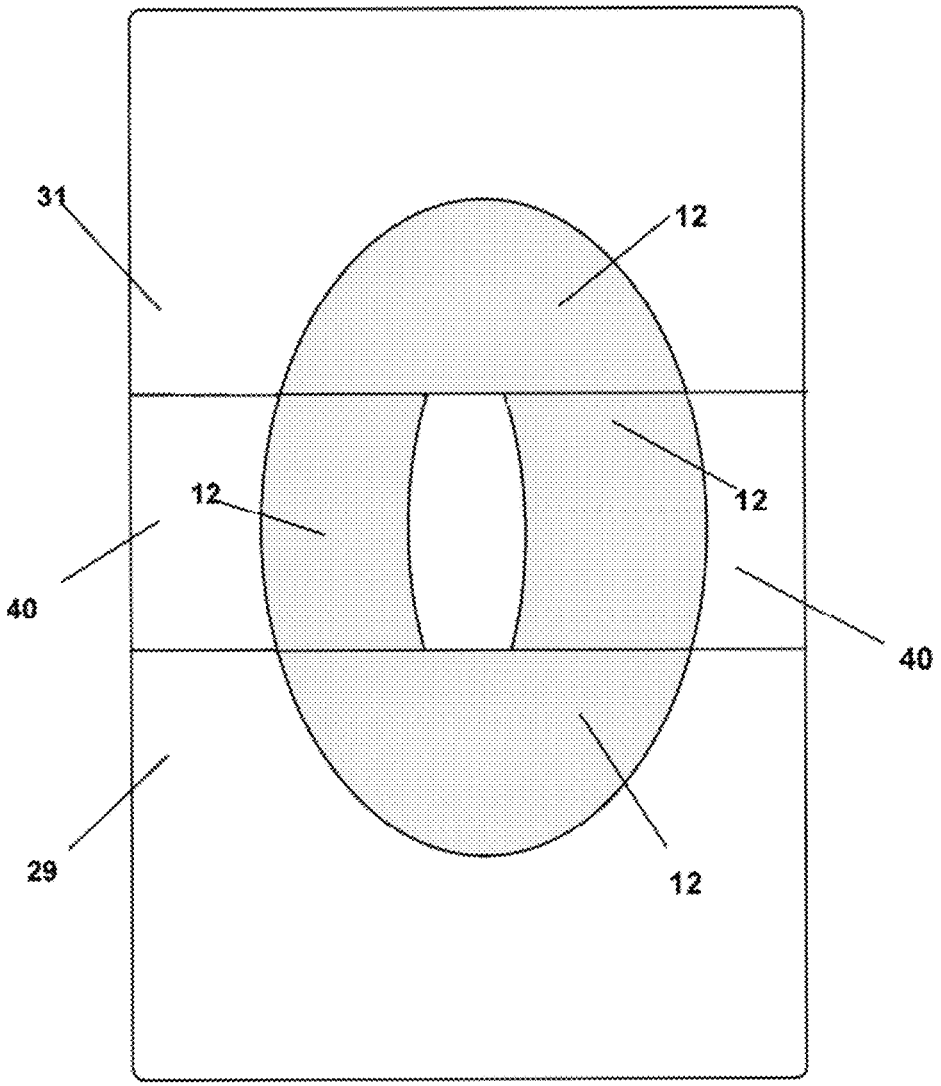
FIG. 9 depicts another mode of the device in a modular form which is configurable and employable to an as-used position covering the shoulders and body or clothing of a user.

As shown in FIG. 9, the device 10 may also be employed to isolate the head and neck area of a user's body, from the surrounding body, or clothing, during hairdressing or cosmetic procedures such as nail polish procedures or application of makeup. The device 10 can be positioned to drape over the body of the user below the neck, in either direction and on either side of their respective torso in a second as-used user position. In such a position the device 10 comprises a means for preventing contact of liquids and powders and the like, with the user's body below the neck and clothing. The device 10 in this mode, like other modes herein, may be provided in a plurality of sizes to accommodate a plurality of people sizes and potential encounters with liquid or powders and the like.

In the mode of the device 10 employable for user liquid or powder or other contact protection, underlying surface 12 of non slip and/or liquid impervious material, may also be engaged such that it will communicate into the area of the sink aperture 14 as shown in FIG. 9.

As can be discerned by those skilled in the art on reading this disclosure, and viewing the figures, there can be an infinite variability of the size of the device 10 itself, as well as the same infinite variability of differing sink apertures 14 and openings 20 to accommodate any type and number of respective sink shapes and sizes, or opening sizes and shapes. Such can be accommodated by varying the size and shape of the components in the modular kit. Additionally, spacing and distance between the apertures and openings may also vary infinitely depending on the eventual site for use. As such, the depictions in the figures herein should in no way be considered limiting in any fashion as to the sole configurations of the device 10 and the sink apertures 14 and openings 20 as well as the positioning of the indica 30 thereon.

FIG. 10 depicts an additional favored mode of the device 10 herein. As depicted the device 10 would be employed in a setting where the sink and countertop dimensions are known, for instance in a large hotel with hundreds of rooms. As depicted the device 10 is formed to the known dimensions of the sink and the surrounding counter in a hotel or other room occupied by guests and can be provided in a single piece with openings 20 formed in the appropriate positions and the appropriate shape and size sink aperture 14 also positioned on the device 10.

In this mode the device 10 may be provided formed of paper or other material which is recyclable, and having the underlying surface 12 (FIG. 1) of non slip and/or liquid impervious material 12 laminated or otherwise operatively positioned thereon to maintain the top surface of the device 10 dry and sanitary. Such might be a laminated polymeric film which also could have a facing surface to contact the counter which would prevent sliding.

The device 10 can be provided in a planar mode either rolled or otherwise situated for the guest to find and use when desired. To show that the device 10 is new and unused, the sink aperture 14 may be formed by placing cuts or a frangible line 15 in the material forming the device 10 such that the sink aperture 14 to surround the known dimensions of the room sink can be formed by the user. This may be accomplished by removing a central section 17 by tearing the material along the preformed frangible line 15. Indicia 30 may be placed on the central section 17 advertising the establishment and showing their concern for the guest's comfort.

Also, this mode of the device 10 is especially well suited for in-room advertising and promotion. Indicia 30 may be placed on other portions of the device 10 in the form of coupons or ads or other promotional indica 30. For example frangible lines 15 may be formed in outlying areas of the material forming the device 10 such as adjacent the side edges, to provide for removable coupons for guest use such as at a restaurant or local amusement park, or to advertise a discount on the hotel services which would be an extra charge and generate more income. The placement of advertisement on the device 10 would either help defer the cost of providing the device 10 to every guest, or could also provide an additional source of revenue and profit to the establishment providing the device 10 in this mode to guests. As with all other modes of the device 10 herein, the material forming the device 10 may be impregnated or surfaced or otherwise imparted with pathogen inhibiting materials such as silver nitrate or aluminum nitrate or other materials inhibiting bacteria and viruses and the like.

Shown in FIG. 10*a* is a mode of the device 10 which may be employed wherein there are a plurality of removable portions bounded by frangible lines 15 formed into the material forming the device 10. As depicted the size of the removable portion surrounded by frangible lines 15 is chosen by the user to match the perimeter of the mating sink to the device 10. All modes herein which provide removable sections to form the aperture for the sink may employ this mode.

Shown in FIG. 11 is a mode of the device 10 having engageable components such as in FIG. 3, wherein the provided plurality of engageable components to form the device 10 are defined by frangible lines 15 cut into the material forming a planar sheet. The frangible lines 15 or separations render the components for forming a device 10 separable from the planar sheet containing them.

FIG. 12 depicts another mode of the device herein similar to that of FIG. 11 wherein the components to modularly form the device 10 may be separated from the planar sheet of material containing them, along frangible lines 15 defining their shape and number. Tape or peel and stick adhesive or other means to joint the components in the manner noted above can be provided with the planar sheet of material.

Although the disclosed cover for sink-surrounding device herein has been described with respect to particular embodiments thereof, it should be realized that various changes and modifications may be made therein without departing from the spirit and scope of the invention. While the invention as shown in the drawings and described in detail herein discloses arrangements of elements of particular construction and configuration for illustrating preferred embodiments of sink surrounding protective structure and methods and modes of operation of the present invention, it is to be understood, however, that elements of different construction and configuration and other arrangements thereof, other than those illustrated and described, may be employed in accordance with the spirit of this invention. Any and all such changes, alternations and modifications, as would occur to those skilled in the art, are considered to be within the scope of this invention as broadly defined in the appended claims.

What is claimed is:

1. A cover apparatus for covering a surrounding surface adjacent a sink, comprising:

a body, said body being formed of flexible material having a first surface and a second surface opposite said first surface;

said body configured with an aperture communicating between said first surface and said second surface in a central portion thereof, said aperture having a shape defined by an aperture edge;

said shape of said aperture being complimentary to a shape of said sink defined by a perimeter edge of a sink supported by a surrounding surface, whereby said body completely surrounds said sink when said aperture is placed in an as-used position, with said aperture edge adjacent all of said perimeter edge and said first surface in contact with said surrounding surface extending away from all of said perimeter edge;

said aperture edge surrounding an open area, said open area defining a passage adapted for direct contact with bottom and side surfaces of said sink therethrough, and adapted for passing of liquid therethrough;

said body in said as-used position, shielding a user from contact with said surrounding surface surrounding and concurrently shielding said surrounding surface from said liquid which may be communicating to said sink through said open area;

said body formed of multiple engageable components;

said components including a first side portion and a second side portion which are positioned on opposing sides of said sink in said as-used position;

a portion of said aperture formed into each of said first side portion and said second side portion;

a first central section removably engageable between edges of said first side portion and said second side portion, said first central section having another portion of said aperture formed therein;

a second central section removably engageable between said edges of said first side portion and said second side portion in position opposite said first central section;

said second central section having at least one opening positioned therein in a communication between said first surface and said second surface;

said opening in a registered position upon said body to provide a passage for a faucet through said body in said as-used position, said opening formed within said second central section;

whereby said multiple engageable components are engageable with each other through removable means of engagement, and said body may be assembled therefrom and placed in said as-used position;

said multiple engageable components including a plurality of said second central sections; and each of said plurality of second central sections having a different configuration of said opening to match a differently configured faucet and allow passage therethrough when said body is placed in said as-used position.

2. The cover apparatus of claim 1, additionally comprising:

said first surface being a liquid barrier to prevent passage of liquid through said body.

3. The cover apparatus of claim 1, additionally comprising:

said first surface being a liquid barrier to prevent passage of liquid through said body.

4. The cover apparatus of claim 1, additionally comprising:

said opening having an elastic material positioned therein having a passage therethrough;

said passage sized equal to or smaller than a circumference of said faucet; and said elastic material forming a biased compressive engagement with said faucet with said body in said as-used position, to thereby form a liquid seal preventing liquid from said faucet from a communication with said surrounding surface.

5. The cover apparatus of claim 1, additionally comprising:

said multiple engageable components formed into a sheet of material by frangible lines communicating into said sheet of material; and said multiple engageable components separable from said sheet of material by separating said sheet of material along said frangible lines.

6. The cover apparatus of claim 5, additionally comprising:

indicia upon said second surface, said indica being upon portions of said body which are separable from said body by a user; and said indicia being coupons or advertisements.

* * * * *